US010160253B2

(12) United States Patent
Yip

(10) Patent No.: US 10,160,253 B2
(45) Date of Patent: Dec. 25, 2018

(54) SINGLE-DETENT BINDER

(71) Applicant: Sau Fung Yip, Kowloon (HK)

(72) Inventor: Sau Fung Yip, Kowloon (HK)

( * ) Notice: Subject to any disclaimer, the term of this patent is extended or adjusted under 35 U.S.C. 154(b) by 0 days.

(21) Appl. No.: 15/686,477

(22) Filed: Aug. 25, 2017

(65) Prior Publication Data

US 2017/0348995 A1 Dec. 7, 2017

Related U.S. Application Data

(63) Continuation-in-part of application No. 14/980,271, filed on Dec. 28, 2015, now Pat. No. 9,744,795.

(30) Foreign Application Priority Data

Nov. 25, 2015 (CN) ..... 2015 1 0834257

(51) Int. Cl.

| | |
|---|---|
| ***B42F 13/16*** | (2006.01) |
| ***B42F 13/20*** | (2006.01) |
| ***B42F 13/22*** | (2006.01) |
| ***B42F 13/26*** | (2006.01) |
| ***B42F 13/36*** | (2006.01) |

(52) U.S. Cl.

CPC ..... *B42F 13/26* (2013.01); *B42F 13/16* (2013.01); *B42F 13/20* (2013.01); *B42F 13/22* (2013.01); *B42F 13/36* (2013.01)

(58) Field of Classification Search

CPC ..... B42F 13/16; B42F 13/20; B42F 13/22; B42F 13/26

USPC ..... 402/29–31, 36–39

See application file for complete search history.

(56) References Cited

U.S. PATENT DOCUMENTS

| | | | | |
|---|---|---|---|---|
| 7,828,491 | B2 * | 11/2010 | Cheng | B42F 13/26 402/19 |
| 2005/0013654 | A1 | 1/2005 | Cheng et al. | |
| 2005/0201817 | A1 * | 9/2005 | Cheng | B42F 13/0066 402/38 |
| 2006/0056906 | A1 * | 3/2006 | Horn | B42F 13/26 402/31 |
| 2008/0075527 | A1 * | 3/2008 | Pi | B42F 13/26 402/41 |
| 2008/0124166 | A1 * | 5/2008 | Zhang | B42F 13/26 402/38 |
| 2008/0175652 | A1 * | 7/2008 | Cheng | B42F 13/26 402/38 |

(Continued)

*Primary Examiner* — Kyle R Grabowski
(74) *Attorney, Agent, or Firm* — Brett A. Schenck

(57) ABSTRACT

A single-detent binder for a file folder has a housing, one pair of baseplates, ring shaped components, a control component, a pull rod, rotary locking pieces and an intermediate junction component. The control component, intermediate junction component, pull rod and rotary locking pieces are connected in series. When the control component rotates, the rotary locking pieces are triggered to rotate in the trough of the first baseplate based on the mechanical principle of connecting rod, thus performing the locking/unlocking function. When the binder is closed, the baffle plates on the second baseplate hinder the rotary locking pieces from rotation, thus generating a clamping force. After the baffle plates and rotary locking pieces work jointly to close the binder, the ring shaped components generate a scrambling force, thus enhancing the locking effect and preventing the single-detent binder from opening unexpectedly.

19 Claims, 14 Drawing Sheets

(56) References Cited

U.S. PATENT DOCUMENTS

| | | | | |
|---|---|---|---|---|
| 2011/0170942 | A1* | 7/2011 | Huang | B42F 13/26<br>402/31 |
| 2015/0117934 | A1* | 4/2015 | Cheng | B42F 13/16<br>402/38 |

* cited by examiner

SINGLE-DETENT BINDER

CROSS-REFERENCE TO RELATED APPLICATIONS

This application is a continuation-in-part of application Ser. No. 14/980,271, filed on Dec. 28, 2015, which claims foreign priority benefits under 35 U.S.C. § 119(a)-(d) to CN 2015108342571.1 filed on Nov. 25, 2015, which is hereby incorporated by reference in its entirety.

STATEMENT REGARDING FEDERALLY SPONSORED RESEARCH OR DEVELOPMENT

Not Applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a single-detent binder for holding loose-leafpaper sheets, and in particular, a single-detent binder that is provided with a pull rod and locking pieces so as to enhance the locking function.

2. Description of Related Art Including Information Disclosed Under 37 CFR 1.97 and 37 CFR 1.98

In order to insert or take out loose-leaf paper sheets conveniently, a single-detent binder (also known as a loose-leaf ring binder) is widely used for a file folder or a note book. As known in the prior art, a typical single-detent binder mainly comprises an elongate curved housing, a pair of elongate baseplates, a plurality of ring shaped components and one or more control handles. The two longitudinal sides of the housing are bent inwards to form two inner sides. The pair of baseplates is located inside the cavity formed by the curved housing, so that one of the two longitudinal sides of each baseplate abuts upon the inner side of the housing while the longitudinal sides on the other side of the baseplates are interconnected in parallel, thus forming a central hinge possessing a pivot axis. Each baseplate is fixedly connected to a plurality of half ring shaped elements. At least one end of the loose-leaf binder is usually connected to a control handle, and the control handle is able to operate one pair of baseplates and move the central hinge upwards or downwards, so that the half ring shaped elements connected to the baseplates reciprocate between the open and closed positions.

A typical loose-leaf ring binder has a defect that the when the half ring shaped elements close, they cannot occlude together reliably. If the mechanism falls accidentally, the ring shaped components may be opened unexpectedly. As is known in the prior art, a single-detent binder can also comprise a locking system, thus enhancing the locking function and preventing the ring shaped components from being opened unexpectedly. The locking system usually comprises a pull rod and a plurality of locking components. The pull rod is positioned between the housing and baseplates, and the locking components are positioned on the locking portion of the pull rod and protruded towards the direction of the baseplates. The locking components are able to reciprocate together with the pull rod between the locking position at which the pivoting movement of the baseplates is blocked and the unlocking position.

The prior single-detent binder possessing a locking system is of relatively complex design. Firstly, each locking component demands a specific shape that matches the openings on the baseplates. Secondly, the pull rod is positioned between the housing and baseplates, and the housing demands a specific shape and thickness for accommodating the pull rod and the protruding locking components on its surface. Thirdly, the initial force of the typical single-detent binder comes from the force applied to the control handle, but the applied force cannot be evenly transferred to the whole baseplates under certain circumstances (for example, the housing is slightly deformed), thus causing a failure in pivoting of the baseplates.

BRIEF SUMMARY OF THE INVENTION

To overcome the defects of the prior art above, the present invention provides a loose-leaf binder possessing a simple locking structure.

To attain the objective of the present invention, the present invention provides a single-detent binder, comprising: a housing, wherein said housing is provided with a closed longitudinal end and an open longitudinal end; one pair of baseplates, wherein said one pair of baseplates is longitudinally adjacent and parallelly arranged and connected, said one pair of baseplates is so assembled as to pivot around said adjacent longitudinal edge in order to open or close ring shaped components, and the non-adjacent longitudinal edges of said one pair of baseplates abut upon the inner side of said housing; one or more ring shaped components, wherein said ring shaped components each comprise two half ring shaped elements, said half ring shaped elements each are fixed on said one pair of baseplates and pass through said housing, said half ring shaped elements occlude to form a closed ring, said half ring shaped elements disjoin to form an opened ring; a control component, wherein said control component comprises (i) a handle, which enables said control component to move relative to said housing, (ii) an upper extension arm, wherein said upper extension arm is connected to one end of an intermediate junction component, (iii) a lower extension arm, wherein said lower extension arm is provided with a pivot pin, so that said control component pivots around a pivot axis that coincides with the pivot pin, and (iv) a groove, wherein said groove is connected to one longitudinal end of said baseplates; an intermediate junction component, wherein one end of said intermediate junction component is connected to said upper extension arm, and the other end of said intermediate junction component is connected to a pull rod; and a pull rod, wherein said pull rod is provided with an elongate main rod and a connection end and said connection end is connected to said intermediate junction component. Said single-detent binder is characterized in that: said single-detent binder also comprises one or more rotary locking pieces and one or more baffle plates on said one baseplate; one end of the upper surface of said rotary locking piece is rotatively connected to one said baseplate, and the other end of the lower surface of said rotary locking piece is rotatively connected to said pull rod; and longitudinal movement of said pull rod can trigger the rotation of said rotary locking piece(s).

Further, said control component, said intermediate junction component, said pull rod and said rotary locking pieces are connected in series; consequently, when said control component rotates downwards, said control component pulls said intermediate junction component to move longitudinally toward the open longitudinal end of said housing and triggers said pull rod to move longitudinally toward the open longitudinal end of said housing, and longitudinal movement of said pull rod can trigger said rotary locking pieces to rotate toward the open longitudinal end of said housing; contrarily, when said control component rotates upwards, said control component pushes said intermediate junction component to move longitudinally toward the closed longitudinal end of said housing and triggers said pull rod to move longitudinally toward the closed longitudinal end of said housing, and longitudinal movement of said pull rod can trigger said rotary locking pieces to rotate toward the closed longitudinal end of said housing.

Furthermore, said intermediate junction component comprises a hooked end, a widthwise end and an intermediate junction rod, wherein said intermediate junction component passes through the widthwise end and is then connected to the control component via an open trough on the upper extension arm, and said intermediate junction component also passes through the hooked end and is then connected to the pull rod via a small hole at the connection end of the pull rod.

Said single-detent binder also comprises rotary locking nails, wherein said rotary locking nails rotatively connect said rotary locking pieces to said pull rod.

Further, said rotary locking pieces each comprise a main body, wherein one end of the upper surface of said main body comprises a projecting cylinder, and said projecting cylinder is clamped in the trough of the first baseplate so as to fix the rotary locking pieces on the first baseplate and allow the rotary locking pieces to rotate in said trough. Said main body comprises a small hole at the end opposite to the projecting cylinder, and said rotary locking pieces are inserted into the small hole of said main body via the round hole in the pull rod by using rotary locking nails, so that the rotary locking pieces are rotatively connected to the pull rod.

Favorably, said main body assumes an egg shape, wherein one end is wider than the other end of it.

Favorably, said rotary locking pieces are made of plastics, metal, or an appropriate lightweight material that possesses enough rigidity and stability.

Favorably, said second baseplate also comprises one or more upper cutting shoulders and one or more lower cutting shoulders, and the baseplate edge between said upper cutting shoulders and said lower cutting shoulders is downward bent, thus forming said baffle plate(s). Said baffle plates(s) is/are so positioned, when said rotary locking pieces rotate in the trough of the first baseplate, to press and obstruct the rotary locking pieces from rotation and generate a clamping force.

Further, said baffle plates(s) is/are so positioned that said baffle plates(s) restrict further rotation of said rotary locking pieces when said rotary locking pieces rotate to the middle position of said baffle plate(s) and touch the said baffle plate(s), thus generating a clamping force.

Favorably, said pull rod is positioned below said baseplates. Said intermediate junction component is positioned between the housing and baseplates. Said first baseplate and a large groove on said second baseplate jointly constitute a gap, allowing one end of said intermediate junction component to pass through it, and allowing said one end of said intermediate junction component to expose outside the bottom surface of said baseplate and then connect to said pull rod below said baseplate.

Favorably, said one or more rotary locking pieces are evenly connected to said first baseplate, so that the upper extension arm evenly transfers the force applied by said control component to the pull rod and the rotary locking pieces connected to it.

Furthermore, said rotary locking pieces and said baffle plates are positioned face to face on said baseplate, and the number of said rotary locking pieces is the same as the number of said baffle plates.

The present invention provides another single-detent binder, wherein said single-detent binder comprises: a housing; baseplates comprising one pair of baseplates, wherein said one pair of baseplates is longitudinal adjacent and parallelly arranged and connected, said one pair of baseplates is so assembled as to pivot around said adjacent longitudinal edge in order to open or close ring shaped components, and the non-adjacent longitudinal edges of said one pair of baseplates abut upon the inner side of said housing; one or more ring shaped components, wherein said ring shaped components each comprise two half ring shaped elements, said half ring shaped elements each are fixed on said one pair of baseplates and pass through said housing, said half ring shaped elements occlude to form a closed ring, said half ring shaped elements disjoin to form an opened ring; a control component, wherein said control component comprises (i) a handle, which enables said control component to move relative to said housing, (ii) an upper extension arm, wherein said upper extension arm is connected to one end of a pull rod, (iii) a lower extension arm, wherein said lower extension arm is provided with a pivot pin, so that said control component pivots around a pivot axis that coincides with the pivot pin, and (iv) a groove, wherein said groove is connected to one longitudinal end of said baseplates; and a pull rod, wherein said pull rod is provided with a elongate main rod and a connection end and said connection end is connected to said control component. Said single-detent binder is characterized in that: said single-detent binder also comprises one or more rotary locking pieces and one or more baffle plates on said one baseplate; one end of the upper surface of said rotary locking piece is rotatively connected to one said baseplate, and the other end of the lower surface of said rotary locking piece is rotatively connected to said pull rod; and longitudinal movement of said pull rod can trigger the rotation of said rotary locking piece(s).

Some of the other characteristics of the present invention are plain to see, and some of them are set forth below.

The locking system of the present invention is of simple structure. For example, the pull rod does not need to be provided with a locking component, thus facilitating industrial manufacture and application. In addition, said pull rod is mounted outside the baseplates, the thickness between the housing and baseplates is relatively thin, and said pull rod can match any type of housing, so as to meet the different thickness designs for a file folder and notebook binder. Further, the control component, intermediate junction component, pull rod and rotary locking pieces are connected in series. When the control component rotates, the rotary locking pieces are triggered to rotate in the trough of the first baseplate, thus performing the locking/unlocking function. When the binder is closed, the baffle plates on the second baseplate hinder the rotary locking pieces from rotation. After the baffle plates and rotary locking pieces work jointly to close the binder, the ring shaped components generate a scrambling force, thus enhancing the locking effect and preventing the single-detent binder from opening unexpectedly. Furthermore, the baffle plates and rotary locking pieces work jointly to ensure the locking positions of the half ring shaped elements and reduce the possibilities that the groove at the front end of each semicircular component fails to exactly occlude with the matched protruding tooth. Finally, the rotary locking pieces are evenly distributed on the baseplates. When a force is applied to the control component, the force not only acts upon the baseplates directly, but also is evenly transferred to the pull rod and the rotary locking pieces connected to it via the upper extension arm; the rotary locking pieces are rotatively connected to the baseplates, the force is also transferred to the baseplates indirectly, thus enhancing the unlocking effect.

DETAILED DESCRIPTION

Figure 1:
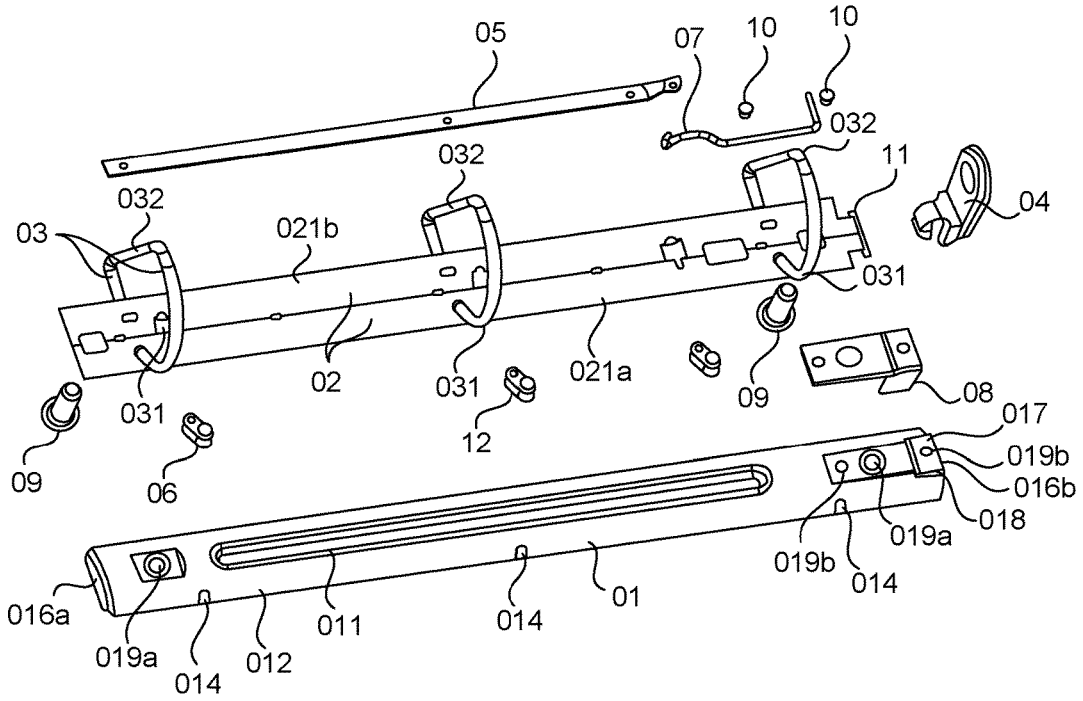
FIG. 1 shows a diagram on the breakdown structure of the present invention.

As shown in FIG. 1, the loose-leaf binder provided in the present invention mainly comprises a housing (01), one pair of baseplates (02), ring shaped components (03), a control component (04), a pull rod (05), rotary locking pieces (06) and an intermediate junction component (07).

As shown in FIGS. 1, 9 to 12, the housing (01) is a longitudinal extended elongate structure, made of metal or another appropriate lightweight material that possesses enough rigidity and stability. At the top of said housing (01) is an elongate sunken space (011). The housing (01) is downwards bent along the two longitudinal sides at its top, forming two longitudinal side faces (012). The longitudinal sides of the two longitudinal side faces (012) are extended and bent inwards to form two inner sides (013), so that the outer longitudinal edges of one pair of baseplates (02) abut upon the two inner sides (013), thus allowing one pair of baseplates (02) to pivot inside the housing (01). The edged and narrowed inner sides (013) of the housing (01) generate a force source simultaneously, and restrict the pivot angle of the pair of baseplates (02) and the opening/closing angle of the ring shaped components (03). The two inner sides (013) are shorter than the longitudinal side faces (012). One longitudinal side face (012) possesses three locating holes (014), the inner side (013) opposite to the longitudinal side face (012) possesses three incisions (015), and the half ring shaped elements (031) and the opposite half ring shaped elements (032) pass through three locating holes (014) and incisions (015) respectively. The number of locating holes (014) and the number of incisions (015) are the same as the number of ring shaped components (03). Noteworthily, the number of locating holes (014), incisions (015) or ring shaped components (03) being larger or smaller than the number as indicated in figures is within the scope of protection of the present invention. In addition, the housing (01) allowing the ring shaped components (03) to pass through it in a similar way to the locating holes (014) and incisions (015) is within the scope of protection of the present invention.

The housing (01) possesses two longitudinal ends (016), wherein one longitudinal end is downwards extended and bent inwards to form a closed longitudinal end (016*a*), and the other longitudinal end (016*b*) is opened and is provided with a protruded part (017). Between the protruded part (017) and the longitudinal side faces (012) is a slot (018) through which the downward extension part (085) of the press cap (08) can pass. The longitudinal two ends of the housing (01) respectively possess two large round holes (019*a*), which allow the installation rivets (09) to pass through them for riveting the housing (01), so as to support the height of the binder provided in the present invention and fix the binder provided in the present invention to a file folder, a notebook or another mechanism accommodating a loose-leaf binder. Near one of the two longitudinal ends are two small holes (019*b*), which allow the rivets (10) connected to the press cap (08) to pass through them, so as to rivet the press cap (08) to the housing (01) tightly. A binder that is provided with a press cap or a binder in which the housing and press cap are integrated into one whole nevertheless falls within the scope of protection of the present invention. The bottom of said housing (01) and the two longitudinal side faces (012) work jointly to ensure that the cross section of the housing (01) assumes an arch shape roughly. It should be understood that the housing (01) may assume a shape different from the shapes as shown in these figures or be integrated into a whole mechanism with a file folder or notebook, which is within the scope of protection of the present invention.

As shown in FIGS. 1, 4*a*, 4*b*, 5*a* and 5*b*, one pair of baseplates (02) comprises two symmetrical elongate baseplates including a first baseplate (021*a*) and a second baseplate (021*b*), and is supported by the above housing (01). The pair of baseplates (02) is made of metal or another appropriate lightweight material that possesses enough rigidity and stability. The outer longitudinal edges of the first baseplate (021*a*) and the second baseplate (021*b*) respectively abut upon the two inner sides (013) of the housing (01), and the inner longitudinal edges of the first baseplate (021*a*) and the second baseplate (021*b*) are interconnected in parallel, thus forming a central hinge possessing a pivot axis. The pair of baseplates (02) is provided with fixing holes (022) used to fix the half ring shaped elements (031 and 032), so that the first baseplate (021*a*) and the second baseplate (021*b*) are respectively riveted to the half ring shaped elements (031 and 032) for supporting the ring shaped components (03). The pair of baseplates (02) can move upwards (the central hinge goes toward the housing (01)) or downwards (the central hinge goes away from the housing (01)), while the half ring shaped elements (031 and 032) riveted to the pair of baseplates (02) are triggered to reciprocate between the open and closed positions, thus opening or closing the ring shaped components (03). The pair of interconnected longitudinal sides are respectively provided with a protruding part (023), a large groove (024) and a small groove (025). The protruding part (023) can restrict the pivot angle of the pair of baseplates (02). After the first baseplate (021*a*) and the second baseplate (021*b*) are installed and interconnected, the first baseplate (021*a*) and the large groove (024) on the second baseplate (021*b*) jointly constitute a gap (024*a*). The gap (024*a*) allows the hooked end (071) of the intermediate junction component (07) to pass through it, so that the intermediate junction component (07) is exposed outside the bottom surface of the pair of baseplates (02) and is connected to the pull rod (05) positioned below the pair of baseplates (02). Meanwhile, the first baseplate (021*a*) and the small groove (025) on the second baseplate (021*b*) jointly constitute a gap (025*a*). The gap (025*a*) allows the installation rivet (09) to pass through it, so as to fix the present invention to a file folder, a notebook or another mechanism accommodating a loose-leaf binder. The first baseplate (021*a*) is also provided with three troughs (026) for clamping the projecting cylinders (062) of the rotary locking pieces (06), so as to fix the rotary locking pieces (06) and allow the rotary locking pieces (06) to rotate inside the trough (026). The second baseplate (021*b*) is respectively provided with three upper cutting shoulders (027*a*) and three lower cutting shoulders (027*b*), wherein the baseplate edge between the upper cutting shoulders (027*a*) and lower cutting shoulders (027*b*) is downwards bent and the bending part is perpendicular to the baseplate (021*b*) to form three baffle plates (028). When the baseplate (02) pivot downwards, the baffle plates (028) hinder the rotary locking pieces (06) from rotation, thus generating a clamping force. The number of baffle plates (028) and the number of troughs (026) are respectively equal to the number of rotary locking pieces (06). However, it should be understood that the number of baffle plates (028), troughs (026) or rotary locking pieces (06) being larger or smaller than the number as shown in the figures is within the scope of protection of the present invention. One end of the pair of baseplates (02) is also provided with relatively narrow finger-like parts (029), which are respectively narrower than their respective first baseplate (021*a*) and second baseplate (021*b*). The finger-like parts (029) are longitudinal extended toward the open end (016*b*) of the housing (01), and are so mounted that their inner longitudinal edges are basically aligned at the inner longitudinal edges of the hinge plate and the central hinge. The finger-like parts (029) enable the baseplates (02) to occlude with the control component (04), so that the control component (04) can apply a force to the finger-like parts (029), thus triggering the baseplates (02) to pivot. The actual connection between the baseplates (02) and the control component (04) and their operations are described in detailed below.

Figure 5A:
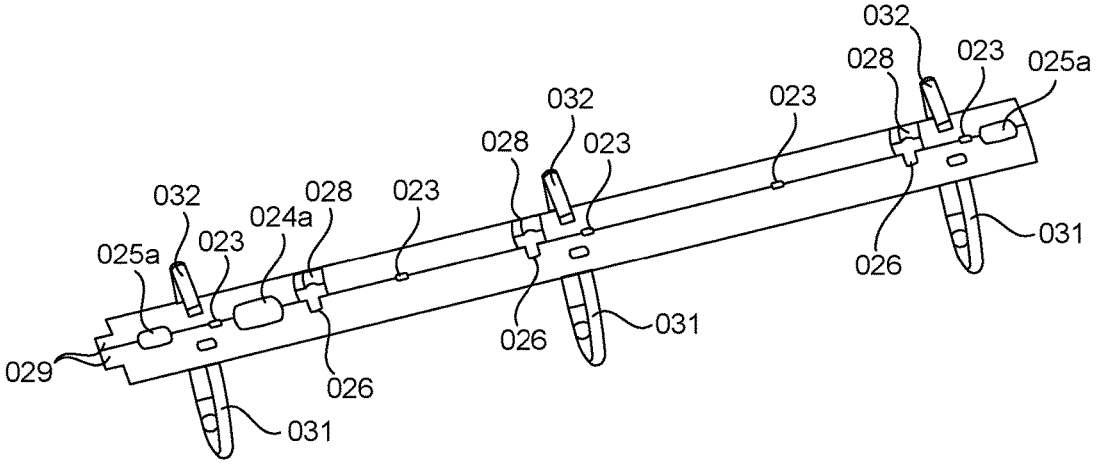
FIG. 5*a* shows a stereogram on the connection of the ring parts and bottom rods in the present invention.
Figure 5B:
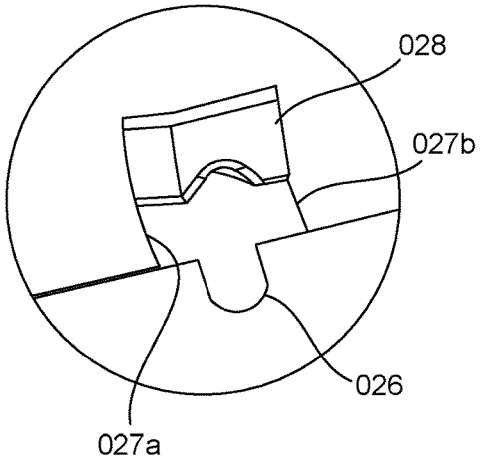
FIG. 5*b* shows a partial enlarged view of FIG. 5*a*, illustrating the structure of the baffle plate on the first bottom rod.
Figure 6A:
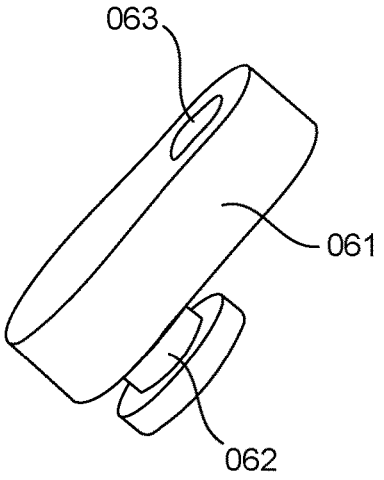
FIG. 6*a* shows a stereogram on the rotary locking pieces provided in the present invention.
Figure 6B:
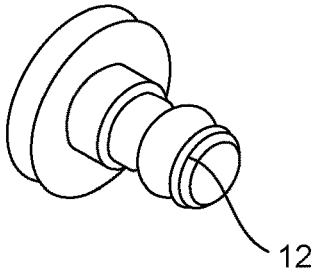
FIG. 6*b* shows a stereogram on the rotary locking nails provided in the present invention.
Figure 6C:
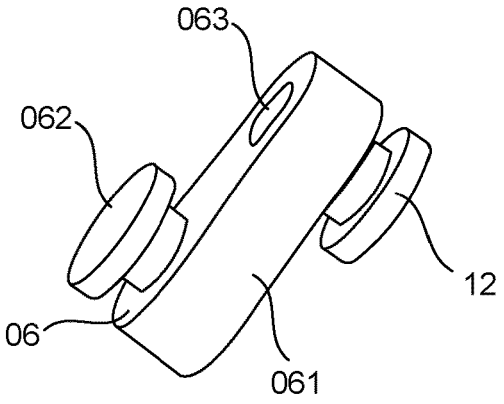
FIG. 6*c* shows a stereogram on the connection of the rotary locking pieces and rotary locking nails in the present invention.
Figure 10:
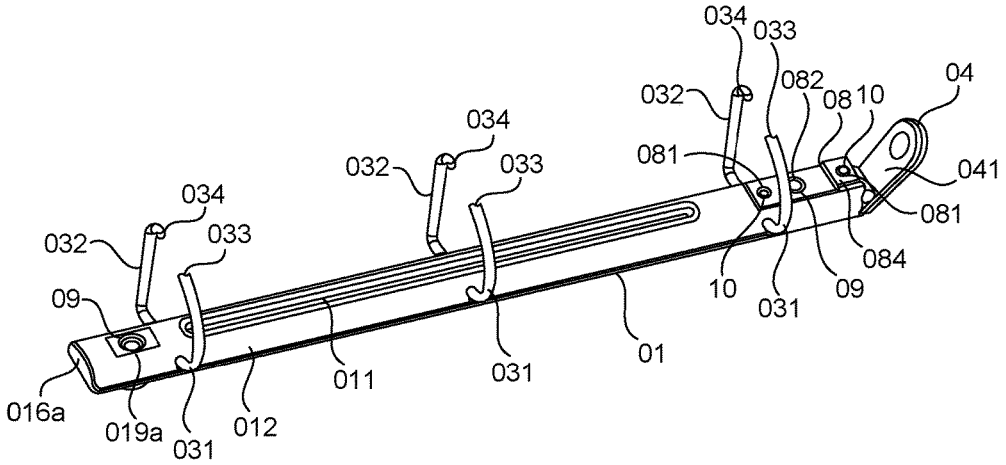
FIG. 10 shows a stereogram on the top of the present invention in unlocking state observed from a favorable position.
Figure 11:
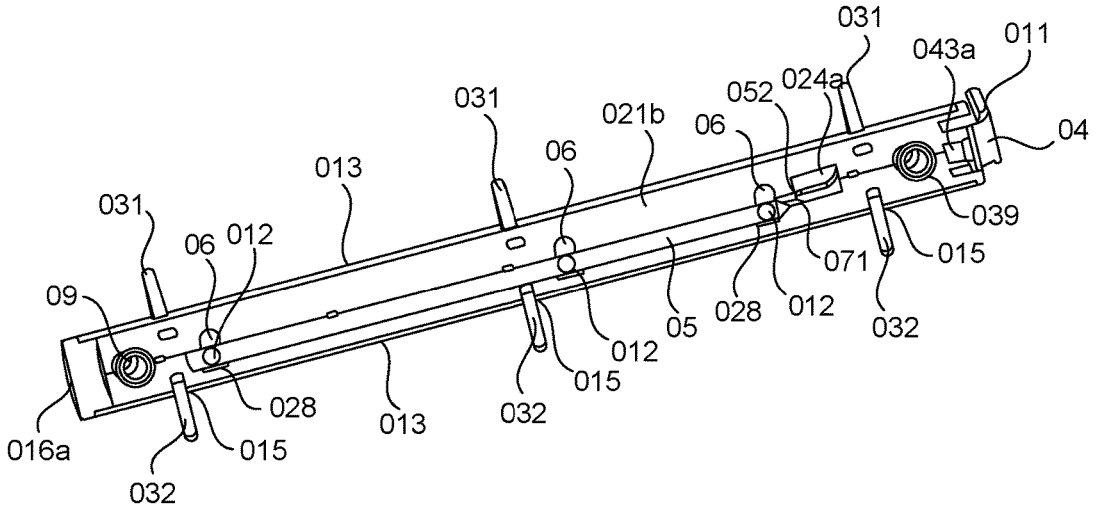
FIG. 11 shows a stereogram on the bottom of the present invention in locking state observed from a favorable position.
Figure 12:
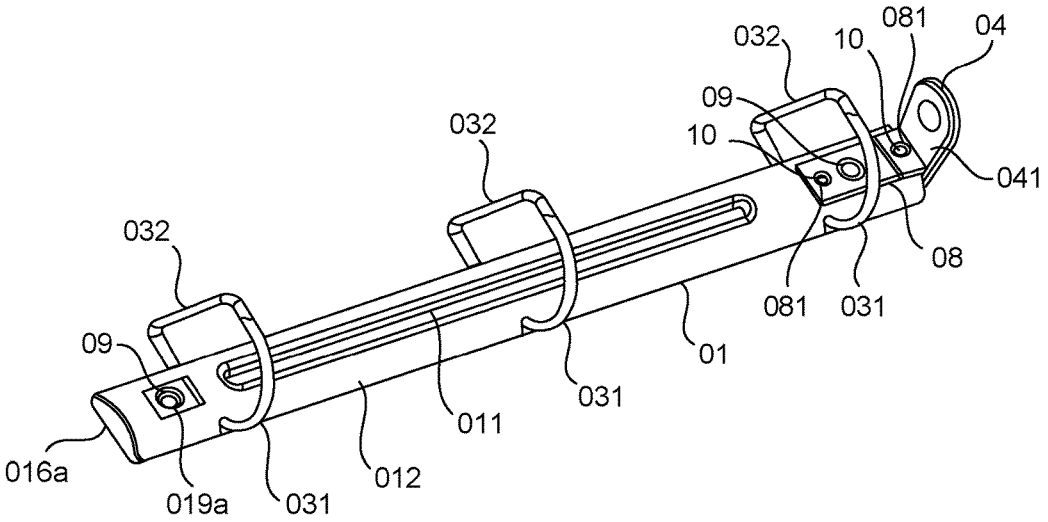
FIG. 12 shows a stereogram on the top of the present invention in locking state observed from a favorable position.

As shown in FIGS. 1, 9 to 12, the present invention also comprises ring shaped components (03), made of metal or a cylindrical bar possessing enough rigidity and stability. The ring shaped components (03) are opened for inserting or taking out loose-leaf paper sheets, and are closed for holding loose-leaf paper sheets in a file folder, notebook or another mechanism accommodating loose-leaf paper sheets. These figures show three ring shaped components (03). However, it should be understood that the number of ring shaped components (03) being larger or smaller than the number shown in the figures is within the scope of protection of the present invention. Said ring shaped components (03) each comprise half ring shaped elements (031 and 032). The half ring shaped elements (031 and 032) respectively assume a semicircular shape and a semi-trapezium shape, and are closed to form a D-shaped loop. It should be understood that the present invention comprising ring shaped components made of different materials or assuming different cross-section shapes (for example, circular shape or oval shape) is within the scope of protection of the present invention. The front-end part of the semicircular component (031) is provided with a slot (protruding tooth) (033), and the front-end part of the semicircular component (032) is provided with a protruding tooth (slot) (034) matching the slot (protruding tooth) (033). As shown in FIG. 5*a*, the tail ends of the half ring shaped elements (031 and 032) are respectively riveted to the first baseplate (021*a*) and the second baseplate (021*b*), and move together with the first baseplate (021*a*) and the second baseplate (021*b*) when they pivot. The riveted half ring shaped elements (031 and 032) respectively pass through the locating hole (014) and incision (015) of the housing (01), thus forming a clamping body. After the housing (01), the pair of baseplates (02) and ring shaped components (03) are assembled, the housing (01) is edged and narrowed to generate a force source and restrict the pivot angle of the pair of baseplates (02) and the opening or closing angle of the ring shaped components (03), so that the half ring shaped elements (031 and 032) reciprocate between the open position (FIG. 10) and the closed position (FIG. 12).

Figure 3:
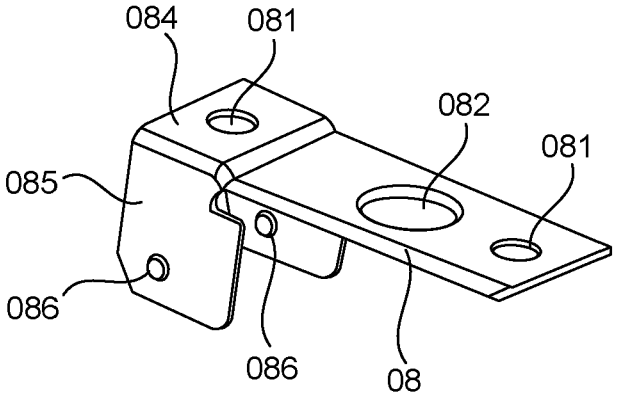
FIG. 3 shows a stereogram on the press cap provided in the present invention.
Figure 4A:
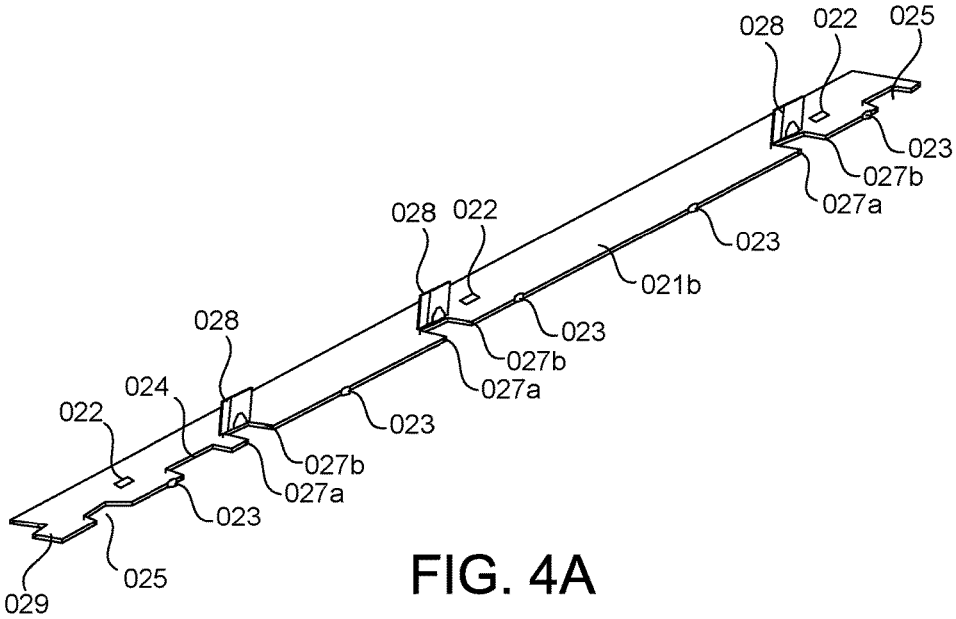
FIG. 4*a* shows a stereogram on the bottom of the first bottom rod provided in the present invention.
Figure 4B:
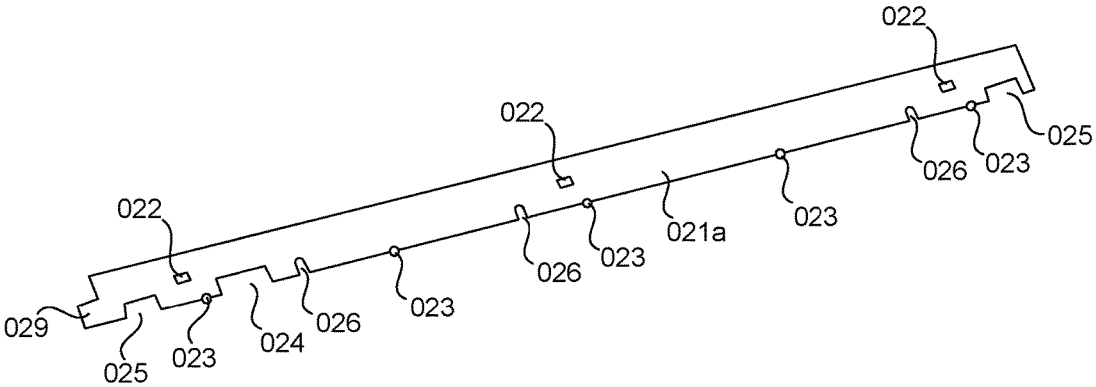
FIG. 4*b* shows a stereogram on the bottom of the second bottom rod provided in the present invention.

As shown in FIGS. 1 and 3, the present invention also comprises a press cap (08), which is used to connect and fix the control component (04) to the housing (01). At the top of the press cap (08) are two small holes (081) and one large hole (082). The press cap (08) is formed separately from the housing (01), and locks the small holes (081) and is fastened to the housing (01) via one or more rivets (10) or other appropriate fasteners. The large hole (082) allows the installation rivet (09) to pass through it. The press cap (08) also comprises a protruding plate (084); after the press cap (08) is riveted to the housing (01), the protruding plate (084) is positioned on the protruding part (017) of the open end (016*b*) of the housing (01). The press cap (08) also comprises a downward extension part (085), which passes through the slot (018) at the open end (016*b*) of the housing (01) and then stretches into the housing (01). At the bottom end of the downward extension part (085) is a small hole (086), allowing the pivot pin (11) to pass through it. The pivot pin (11) passes through the control component (04), so that the control component (04) is pivotally connected to the press cap (08). The control component (04) can pivot around a pivot axis that coincides with the pivot pin (11).

Figure 2:
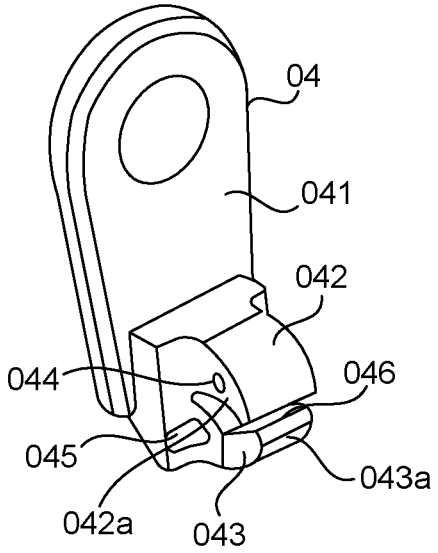
FIG. 2 shows a stereogram on the control component provided in the present invention.

As shown in FIGS. 1 and 2, the loose-leaf binder provided in the present invention also comprises a control component (04), which is mounted at the open end (016*b*) of the housing (01). The control component (04) moves relative to the housing (01), so that the pair of baseplates (02) resists the elastic force of the housing (01) to open or close the ring shaped components (03). The control component (04) is provided with a handle (041); if a force is applied to the handle (041), the control component (04) can pivot around a pivot axis that coincides with the pivot pin (11). The handle (041) assuming different shapes is within the scope of protection of the present invention. The bottom of the handle (041) is downwards and outwards extended to form an upper extension arm (042) and a lower extension arm (043). The upper extension arm (042) possesses a hole trough (044), allowing the widthwise end (072) of the intermediate junction component (07) to pass through it. The lower extension arm (043) possesses a hole trough (045), allowing the pivot pin (11) to pass through it. Between the upper extension arm (042) and the lower extension arm (043) is a groove (046), which accommodates the finger-like parts (029) at one end of the pair of baseplates (02). At the end of the upper extension arm (042) is a closing top position (042*a*), and at the end of the lower extension arm (043) is an opening top position (043*a*). When the finger-like parts (029) are accommodated in the groove (046), the closing top position (042*a*) is positioned above the ends of the baseplate (02) while the opening top position (043*a*) is positioned below the ends of the baseplate (02). When the control component (04) rotates downwards and away from the housing (01), the opening top position (043*a*) applies an upward force to the finger-like parts (029) of the baseplate (02), so that the central hinge of the baseplate (02) pivots upwards to open the ring shaped components (03). In addition, when the ring shaped components (03) are opened, a relatively large portion of the control component (04) is longitudinal extended to overstep the open end (016*b*). When the ring shaped components (03) are closed, a relatively small portion of the control component (04) is longitudinal extended to overstep the open end (016*b*). The control component (04) installing in other modes (for example, directly installed on a bracket without a separate press cap (08)) is within the scope of protection of the present invention.

Figure 7:
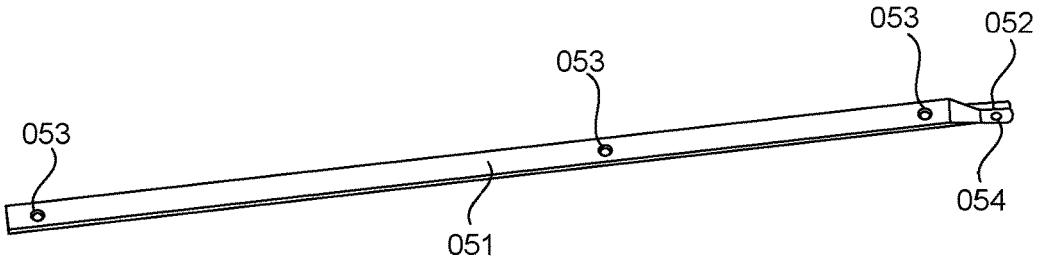
FIG. 7 shows a stereogram on the pull rod provided in the present invention.

As shown in FIGS. 1 and 7, the present invention also comprises a pull rod (05), which is made of metal or another appropriate lightweight material possessing enough rigidity and stability. As compared with a single-detent binder not provided in the present invention, the pull rod (05) is positioned below the baseplates (02), that is, outside the housing (01). The pull rod (05) comprises a longitudinal extended elongate main rod (051) and a connection end (052). The main rod (051) possesses three round holes (053), which allow the rotary locking nails (12) to pass through them and rotatively connect the rotary locking pieces (06) to the pull rod (05). The connection end (052) possesses a small hole (054), allowing the hooked end (071) of the intermediate junction component (07) to pass through it. The number of round holes (053) being larger or smaller than the number shown in the figures is within the scope of protection of the present invention.

As shown in FIGS. 1, 6*a*, 6*b* and 6*c*, the present invention also comprises a rotary locking piece (06) and rotary locking nail (12), which are made of plastics, metal or another appropriate lightweight material possessing enough rigidity and stability. The rotary locking piece (06) comprises a main body (061), which assumes an egg shape. At the broad end of the main body (061) comprises a projecting cylinder (062), which is clamped in the trough (026) of the first baseplate (021*a*) so as to fix the rotary locking piece (06) on the first baseplate (021*a*) and rotate the rotary locking piece (06) in the trough (026). At the narrow end of the main body (061) is a small hole (063). The rotary locking nail (12) passes through the round hole (053) on the pull rod (05) first and then is inserted into the small hole (063) of the main body (061), thus riveting the rotary locking piece (06) to the pull rod (05) rotatively. The locking piece (06) can assume other shapes within the scope of protection of the present invention. After the locking piece (06) works to close the binder, the ring shaped components (03) generate a scrambling force, thus enhancing the locking effect and preventing the single-detent binder from opening unexpectedly.

Figure 8:
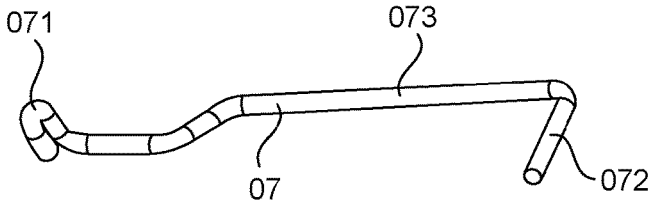
FIG. 8 shows a stereogram on the intermediate junction component provided in the present invention.

As shown in FIGS. 1 and 8, the loose-leaf binder provided in the present invention also comprises an intermediate junction component (07), which is positioned between the housing (01) (at the end close to the open end (016*b*)) and the baseplate (02). The intermediate junction component (07) comprises a hooked end (071), a widthwise end (072) and an intermediate junction rod (073). The widthwise end (072) of the intermediate junction component (07) passes through the hole trough (044) of the upper extension arm (042) and is then connected to the control component (04). Meanwhile, the hooked end (071) of the intermediate junction component (07) is connected to the pull rod (05) by passing through the small hole (054) at the connection end (052) of the pull rod (05). The intermediate junction component (07) connects the control component (04) to the pull rod (05) in series, so that the control component (04) can rotate to trigger longitudinal movement of the pull rod (05). Because the intermediate junction component (07) is positioned between the housing (01) and the baseplate (02) and the pull rod (05) is positioned outside the housing (01) and the baseplate (02), the hooked end (071) passes through the gap (024*a*) of the baseplate (02) and is exposed outside the bottom surface of the baseplate (02), so as to connect to the connection end (052) of the pull rod (05). The intermediate junction component (07) assuming different shapes or be integrated into a whole with the pull rod (05) is within the scope of the protection of the present invention. If the intermediate junction component (07) is integrated into a whole with the pull rod (05) (the single-detent binder does not comprise the intermediate junction component (07)), one end of the pull rod (05) is directly connected to the control component (04).

As shown in FIGS. 9 to 12, one pair of baseplates (02) can upwards and downwards pivot relative to the housing (01) around its adjacent longitudinal edges, so that the ring shaped components (03) mounted on them reciprocate between the open and closed positions. When one pair of baseplates (02) is parallel to each other to form a coplanar position, the width of the pair of baseplates (02) is greater than the inner width of the housing (01), and one pair of baseplates (02) extrudes the housing (01), thus generating an elastic force in the housing (01). Due to the elastic force, the housing (01) tends to narrow so as to restore the original width, and extrudes the baseplate (02) so that the baseplate (02) upwards or downwards pivots away from the coplanar position. When one pair of baseplates (02) pivots upwards, the central hinge moves upwards toward the housing (01); when the included angle between the upper surfaces of the pair of baseplates (02) is larger than 180, the half ring shaped elements associated with the pair of baseplates (02) are opened, so that loose-leaf paper sheets can be inserted into or taken out of the loose-leaf binder. When the pair of baseplates (02) pivots downwards, the central hinge moves downwards away from the housing (01); when the included angle between the upper surfaces of the pair of baseplates (02) is smaller than 180, the half ring shaped elements associated with the pair of baseplates (02) occlude with each other, so as to form a whole ring and hold the loose-leaf paper sheets.

Figure 9:
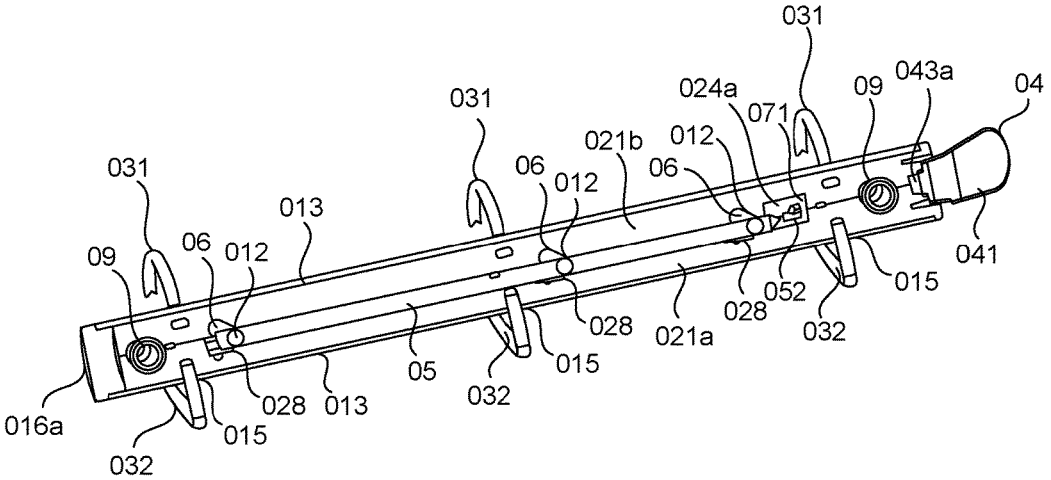
FIG. 9 shows a stereogram on the bottom of the present invention in unlocking state observed from a favorable position.

As shown in FIGS. 9 and 11, the pull rod (05) is connected to one pair of baseplates (02) in series via the rotary locking piece (06) by using a hole, thus forming a locking system that rotates based on the mechanical principle of connecting rod. When the control component (04) rotates downwards away from the housing (01), the control component (04) triggers the intermediate junction component (07) to move longitudinally toward the control component (04) and the pull rod (05) to move longitudinally toward the control component (04). The longitudinal movement of the pull rod (05) can trigger the rotary locking piece (06) to rotate toward the control component (04) in the trough (026) of the first baseplate (021*a*). When the control component (04) rotates upwards toward the housing (01), the control component (04) triggers the intermediate junction component (07) to move longitudinally away from the control component (04) and the pull rod (05) to move longitudinally away from the control component (04). The longitudinal movement of the pull rod (05) can trigger the rotary locking piece (06) to rotate away from the control component (04) in the trough (026) of the first baseplate (021*a*). When the rotary locking piece (06) rotates to the middle position of the baffle plate (028), the rotary locking piece (06) touches the baffle plate (028); then, the baffle plate (028) restricts further rotation of the rotary locking piece (06), thus attaining the locking purpose. After the locking piece (06) works to close the binder, the ring shaped components (03) generate a scrambling force, thus enhancing the locking effect and preventing the single-detent binder from opening unexpectedly.

FIGS. 9 and 10 show an embodiment of the present invention changing from the closed state to the open state. If the handle (041) is pulled outwards and downwards, the control component (04) pivots outwards and downwards around a pivot axis that coincides with the pivot pin (11), and lower extension arm (043) of the control component (04) moves upwards and outwards. The opening top position (043*a*) at one end of the lower extension arm (043) applies an upward force to the finger-like part (029) of the baseplate (02), so that the central hinge of the baseplate (02) pivots upwards. When one pair of baseplates (02) is parallel to each other to form a coplanar position, the width of the pair of baseplates (02) is greater than the inner width of the housing (01), and one pair of baseplates (02) extrudes the housing (01), thus generating an elastic force in the housing (01). Due to the elastic force, the housing (01) tends to narrow so as to restore the original width, and extrudes the baseplate (02) so that the baseplate (02) continues to upwards pivot away from the coplanar position. The central hinge of the baseplate (02) continues to upwards pivot, and meanwhile the baseplate (02) stops pivoting because the baseplate (02) is restricted by the angle of the inner side (013) of the housing (01). At this time, the included angle between the upper surfaces of the pair of baseplates (02) is larger than 180, and the half ring shaped elements associated with the pair of baseplates (02) are opened; then, the present invention is in an open state. On the other hand, the control component (04), intermediate junction component (07) and pull rod (05) are connected in series; therefore, the upper extension arm (042) of the control component (04) can move upwards and outwards to trigger the intermediate junction component (07) to longitudinal move toward the control component (04), and the pull rod (05) to longitudinal move toward the control component (04). The longitudinal movement of the pull rod (05) can trigger the rotary locking piece (06) to rotate toward the control component (04) in the trough (026) of the first baseplate (021*a*), until the baseplate (02) stops pivoting, thus attaining the unlocking purpose.

FIGS. 11 and 12 show an embodiment of the present invention changing from the open state to the closed state. To close and lock the ring shaped components (03), the user can directly grip one or more ring shaped components (03) and make the ring shaped components (03) to move from the open position to the closed position. As a result, the central hinge of the baseplate (02) pivots downwards. When one pair of baseplates (02) is parallel to each other to form a coplanar position, the width of the pair of baseplates (02) is greater than the inner width of the housing (01), and one pair of baseplates (02) extrudes the housing (01), thus generating an elastic force in the housing (01). Due to the elastic force, the housing (01) tends to narrow so as to restore the original width, and extrudes the baseplate (02) so that the central hinge of the baseplate (02) continues to downwards pivot away from the coplanar position. At this time, the slots (033) of the half ring shaped elements (031 and 032) are triggered to butt against the front ends of the protruding teeth (034) mutually, and to support the protruding part (023) of the baseplate mutually, thus generating an interlocking force on the baseplate (02). Meanwhile, the baseplate (02) is locked by the rotary locking piece (06) (as detailed below), so the baseplate (02) stops pivoting. The finger-like part (029) of the baseplate (02) is accommodated in the groove (046) of the control component (04), so the central hinge of the baseplate (02) pivots downwards to extrude the lower extension arm (043) of the control component (04) and the handle (041) is triggered to rotate upwards toward the housing (01). When the handle (041) is obstructed by the press cap (08), the handle (041) stops rotation. On the other hand, the control component (04), intermediate junction component (07) and pull rod (05) are connected in series, so the rotation of the control component (04) triggers the upper extension arm (042) of the control component (04) to move downwards toward the housing (01), thus triggering the intermediate junction component (07) to longitudinal move away from the control component (04) and the pull rod (05) to longitudinal move away from the control component (04). The longitudinal movement of the pull rod (05) can trigger the rotary locking piece (06) to rotate away from the control component (04) in the trough (026) of the first baseplate (021*a*). When the rotary locking piece (06) rotates to the middle position of the baffle plate (028), the rotary locking piece (06) touches the baffle plate (028); then, the baffle plate (028) restricts further rotation of the rotary locking piece (06), thus attaining the locking purpose. After the baffle plate (028) and rotary locking piece (06) work jointly to close the binder, the ring shaped components (03) generate a scrambling force, thus enhancing the locking effect and preventing the single-detent binder from opening unexpectedly.

On the other hand, the rotary locking pieces (06) are evenly distributed on the baseplates (02). When the control component (04) applies a force, the force is not only applied upwards to the finger-like part (029) of the baseplate (02) via the opening top position (043*a*) at the end of the lower extension arm (043), but also evenly transferred to the pull rod (05) and the rotary locking piece (06) connected to it via the upper extension arm (042).

Figure 13A:
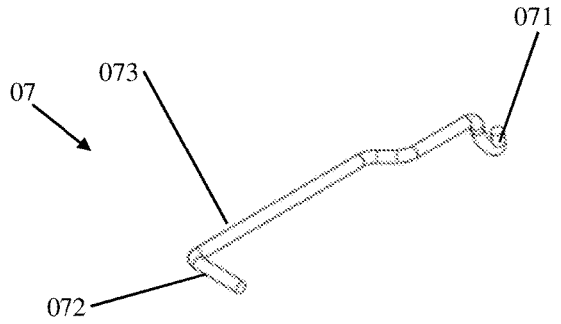
FIG. 13A shows a bottom perspective view of the intermediate junction component.
Figure 13B:
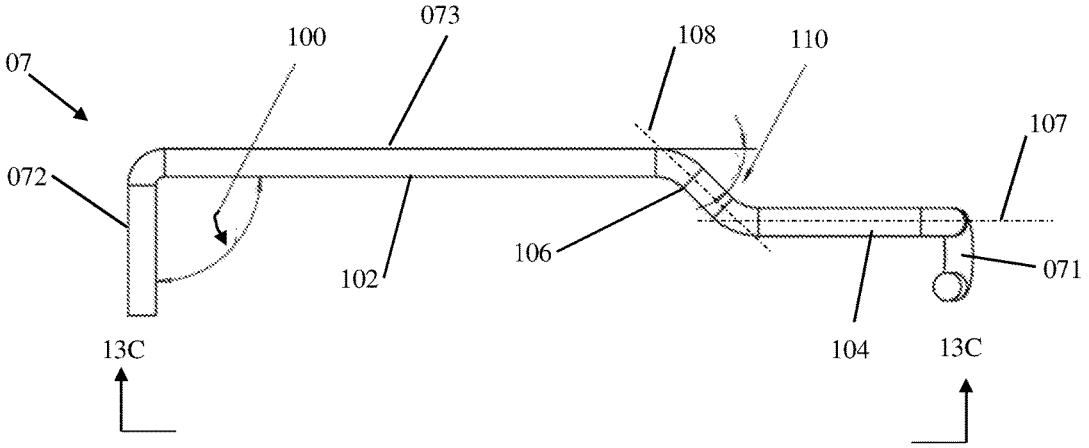
FIG. 13B shows a bottom view of the intermediate junction component.

As shown in FIGS. 8, 13A, 13B, and 13E, the angle (100) (FIG. 13B) between the widthwise end (072) and intermediate junction rod (073) is at a predetermined value that allows the widthwise end (072) to pass through the hole trough (044) of the upper extension arm (042) and connect the intermediate junction component (07) to the handle (041). The angle (100) is at a predetermined value that also prevents the intermediate junction component (07) and handle (041) from separating from each other upon longitudinal movement of the intermediate junction component (07) and handle (041) away from each other. Such longitudinal movement of the intermediate junction component (07) may be caused by pushing the handle (041) downward and outward. The angle (100) may be ninety degrees. As illustrated in FIG. 13B, the intermediate junction rod (073) includes longitudinally parallel outer portion and inner portions (102), (104), and an offset portion (106) positioned between the inner and outer portions (104), (102). The outer portion (102) is attached to the widthwise end (072) and the inner portion (104) is attached to the hook end (071). As illustrated in FIGS. 11, 12 and 13B, the inner portion (104) has a longitudinal axis (107) that intersects the rivets (10). The offset portion (106) is attached to the outer and inner portions (102), (104) and has a longitudinal axis (108) that is at an angle (110) with the inner portion (104). The angle (110) has a predetermined value such that the outer portion (102) and the offset portion (106) avoid touching the rivets (10) during longitudinal movement of the intermediate junction component (07) resulting from the binder being moved between the open and closed positions. That is, the offset portion (106) is at a length and angle (110) with respect to the inner portion (104) such that the outer portion (102) is offset from the inner portion (104) at a distance that provides enough clearance so that the outer portion (102) and the offset portion (106) avoid touching the rivets (10) during longitudinal movement of the intermediate junction component (07) resulting from the binder being moved between the open and closed positions. The angle (110) may be forty five degrees.

Figure 13C:
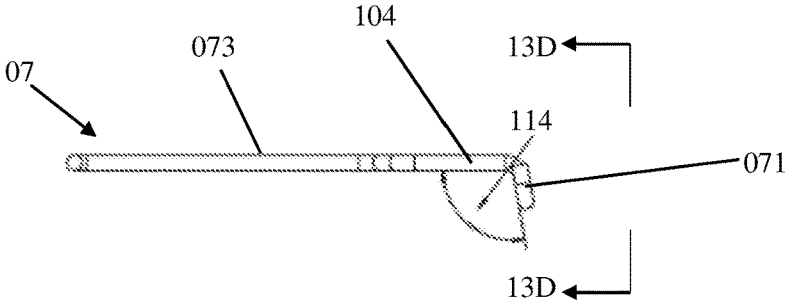
FIG. 13C shows a view taken along line 13C-13C of FIG. 13B.
Figure 13D:
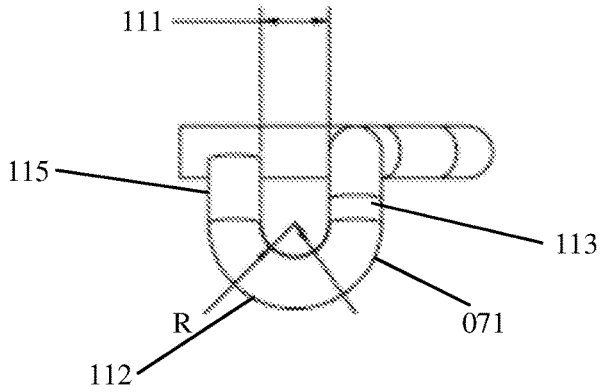
FIG. 13D shows a view taken along line 13D-13D of FIG. 13C.
Figure 13E:
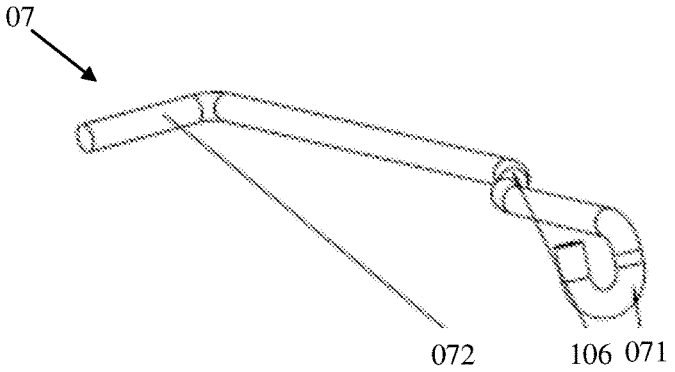
FIG. 13E shows a bottom perspective view of the intermediate junction component as viewed from the side opposite that of FIG. 13A.
Figure 19:
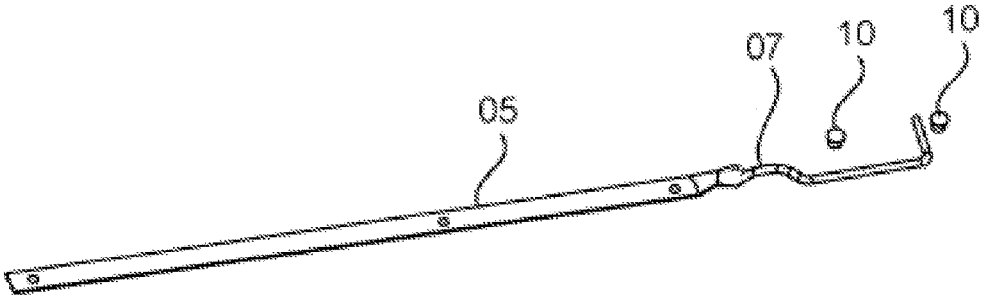
FIG. 19 shows a top perspective view of the rivets for the press cap and the intermediate junction component being integrally formed in one piece with the pull rod.

As illustrated in FIG. 13D, the hook end (071) is u-shaped and comprises a curved bight (112) that has a radius R of sufficient value to tightly hold the hooked end (071) to the connection end (052) of the pull rod (05). In essence, the distance (111) between the legs (113), (115) of the hook end (071) is sufficient value to tightly hold the hooked end (071) to the connection end (052) of the pull rod (05). The radius R may have a value of 2.10 mm. As illustrated in FIG. 13C, the angle (114) between the hook end (071) and the inner portion (104) of the intermediate junction rod (073 is at a sufficient value to tightly hold the hooked end (071) to the connection end (052) of the pull rod (05) to prevent separation of the intermediate junction component (07) from the pull rod (05) during longitudinal movement of the intermediate junction component (07) resulting from the binder being moved between the open and closed positions. The angle (114) may be one hundred degrees. The intermediate junction component (07) is comprised of a rigid non deformable material such as iron so that the angle values are maintained. FIG. 19 shows a top perspective view of the rivets (010) for the press cap (08) and the intermediate junction component (07) being integrally formed in one piece with the pull rod (05).

Figure 14:
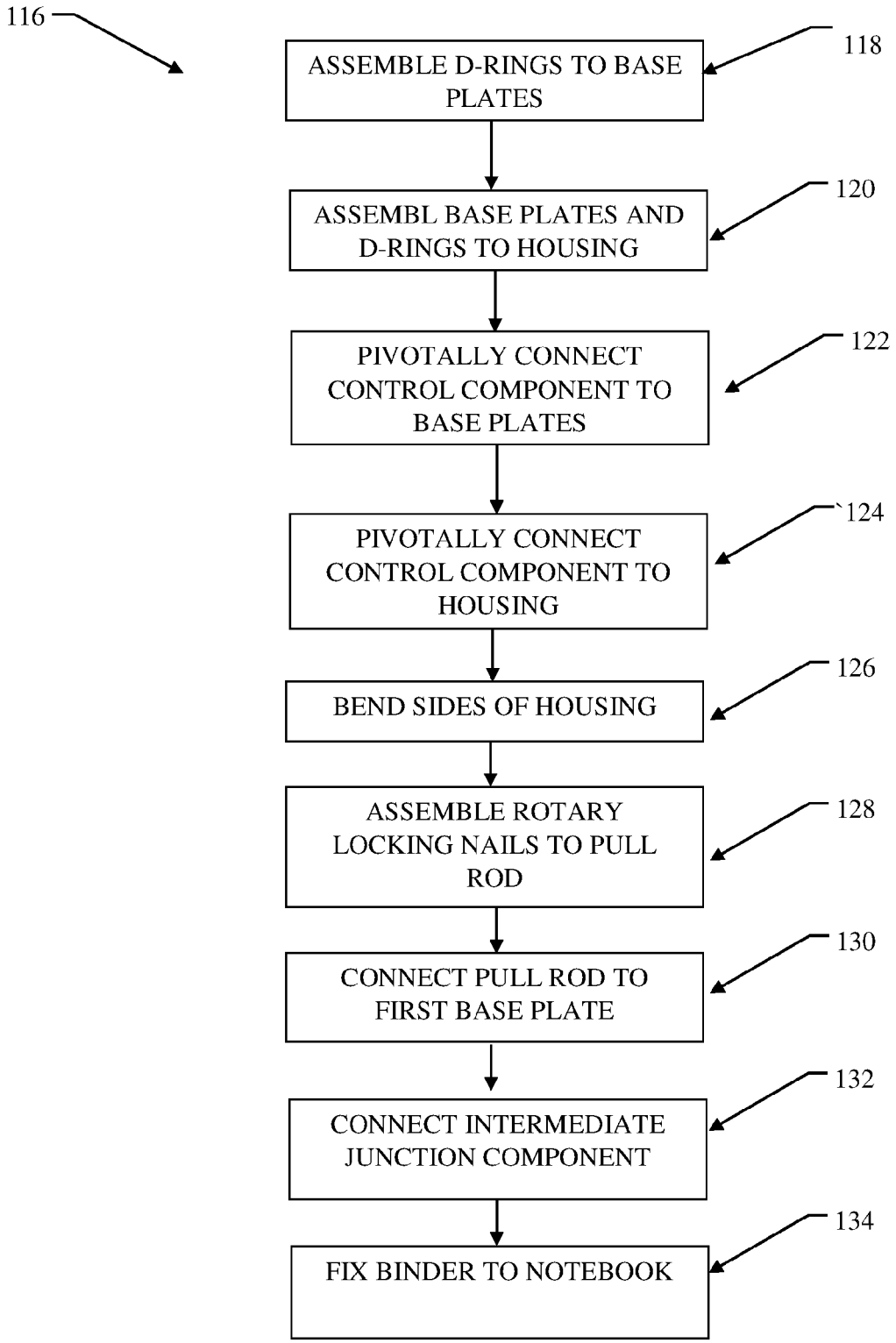
FIG. 14 shows a flow diagram of a method for assembling the parts of the binder of FIG. 1.
Figure 15:
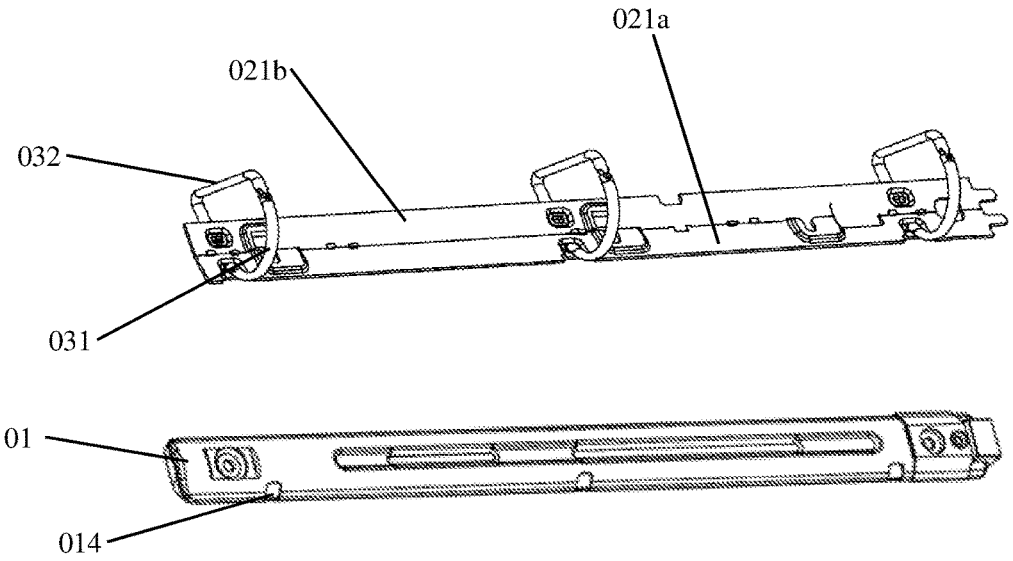
FIG. 15 shows a top perspective view of certain parts of the binder of FIG. 1.

FIG. 14 shows a method (116) of assembling the parts of the binder together. In step (118), the ring shaped components (03) and the first and second baseplates (021*a*), (021*b*) are assembled together as shown in FIG. 15. This is done by riveting the first and second baseplates (021*a*), (021*b*) to the half ring shaped elements (031) and (032) through the fixing holes (022). In step (120), the first and second baseplates (021*a*), (021*b*) are assembled to the bottom of the housing (01) such that the half ring shaped elements (032 pass through the three locating holes (014) and incisions (015) respectively. In step (122), the control component (04) is pivotally connected to the first and second baseplates (021*a*), (021*b*) by passing the pivot pin 11 through the hole trough (045) of the lower extension (043) of the control component (04). In step (124), the control component (04) is pivotably connected to the housing (01) by mounting the press cap (08) to the housing (01) such that the downward extension part (085) of the press cap (08) passes through the slot (018) of the housing (01) and then pivotably connecting the control component (04) to the press cap (08) by passing the pivot pin (11) through the holes (086) of the press cap (08) and the hole trough (045) of the lower extension arm (043) of the control component (04). The control component (04) can pivot around a pivot axis that coincides with the pivot pin (11). The press cap (08) is mounted to the housing (01) by mounting the rivets (010) through the small holes (081) of the press cap (08) and small holes (019*b*) of the housing (01).

In step (126), the longitudinal sides of the two longitudinal side faces (012) are extended and bent inwards to form the two inner sides (013), so that the outer longitudinal edges of the pair of baseplates (02) abut upon the two inner sides (013), thus allowing the baseplates (02) to pivot inside the housing (01).

Figure 16:
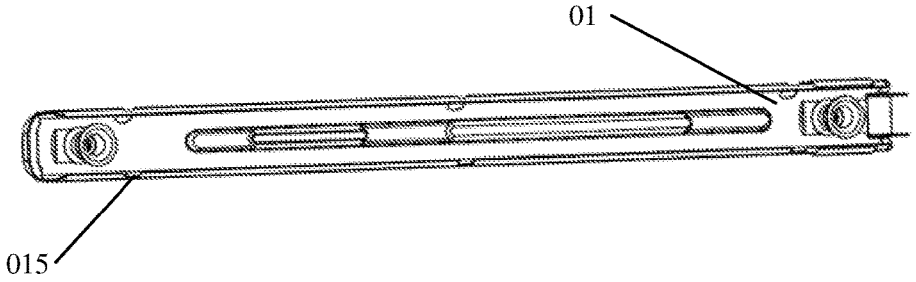
FIG. 16 shows a bottom perspective view of the housing of the binder of FIG. 1.
Figure 17:
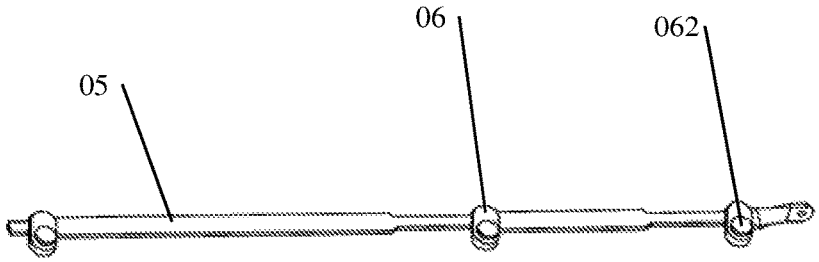
FIG. 17 shows a top perspective view of the pull rod with the rotary lock pieces assembled to it.
Figure 18:
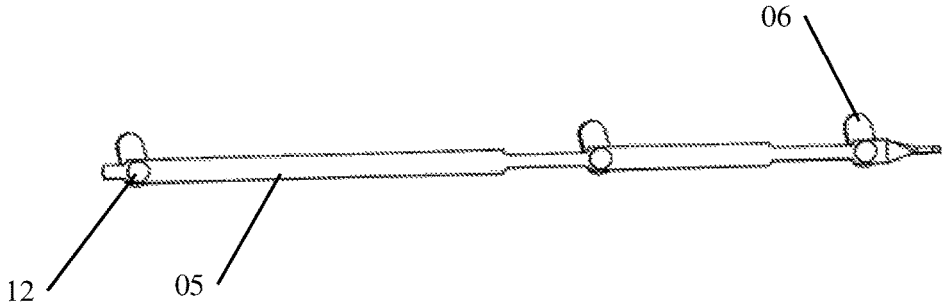
FIG. 18 shows a bottom perspective view of the pull rod with the rotary lock pieces assembled to it.

While steps (118) to (126) are being performed, in step (128), each of the rotary locking pieces (06) are assembled to the pull rod (05) by first inserting one end of the rotary locking nail (12) into the respective round hole (053) of the pull rod (05), and then inserting the other end of the rotary locking nail (12) into the small hole (063) of the main body (061) of the respective rotary locking piece (06), thus riveting the rotary locking piece (06) to the pull rod (05) rotatively. FIG. 15 shows a top perspective view of the parts of the binder that are assembled in steps (118) to (126). FIG. 16 shows a bottom perspective view of the housing (010. FIGS. 17 and 18 show top and bottom perspective views of the pull rod (05) with the rotary lock pieces (06) assembled thereto in step 128. Alternatively, step (128) may be performed before or after the performance of steps (118) to (126).

After steps (118) through (130) are performed, the pull rod is movably connected to the first baseplate in step (130) by clamping the projecting cylinders (062) of the three rotary locking pieces (06) to their respective troughs (026)

of the first baseplate (021*a*) so as to fix the rotary locking pieces (06) and allow the rotary locking pieces (06) to rotate inside the trough (026).

Then, in step (132), the intermediate junction component (07) is connected to the pull rod (05) and the control component (04) by passing the hooked end (071) of the intermediate junction component (07) through the small hole (054) at the connection end (052) of the pull rod (05) and passing the widthwise end (072) of the intermediate junction component (07) passes through the hole trough (044) of the upper extension arm (042). Then, in step (134), the loose-leaf binder is fixed to a notebook or another mechanism accommodating a loose-leaf binder by inserting one installation rivet (09) through the large hole (082) of the press cap (08), the gap (025*a*) and one of the large round holes (019*a*) of the housing (01), and then inserting the other installation rivet (09) through the other round hole (019*a*) and other gap (025*a*), and then riveting the installation rivets (019*a*) to the notebook or other mechanism accommodating a loose-leaf binder. By performing steps (118) to (126) simultaneously with steps (128) to (130), the production lead time is saved, since all the parts are not needed to be ready and assembled together.

When describing the components of the loose-leaf ring binder, this paper uses "one", "the" and "said" to indicate one or more components available. "Comprise", "possess" and "provided with" along with their variants should be open-ended and mean that the present invention can also comprise the components other than the listed components herein. In addition, "front", "rear" and their variants, and other terms of directions and orientations are only used for the purpose of convenience, while no any special directions or orientations are required for the assemblies.

Within the scope of protection of the present invention, the present invention allows a diversity of variations. Therefore, all contents contained or shown in the Specification above and figures should be deemed to be schematic rather than restrictive. Therefore, all equivalent technological changes based on the Specification and figures herein should nevertheless fall within the scope of protection of the present invention.

What is claimed is:

1. A single-detent binder comprising:

a housing provided with a closed longitudinal end and an open longitudinal end;

at least one pair of baseplates, wherein the baseplates of the one pair of baseplates are longitudinally adjacent and parallelly arranged and connected to each other, wherein the one pair of baseplates comprises adjacent longitudinal edges and non-adjacent longitudinal edges;

one or more ring shaped components, wherein the ring shaped components each comprise two half ring shaped elements, the half ring shaped elements each are fixed on the one pair of baseplates and pass through the housing, the half ring shaped elements occlude to form a closed ring, and the half ring shaped elements disjoin to form an opened ring;

wherein the one pair of baseplates is so assembled as to pivot around the adjacent longitudinal edges in order to open or close the ring shaped components, and the non-adjacent longitudinal edges of the one pair of baseplates abut upon an inner side of the housing;

a control component comprising (i) a handle, which enables the control component to rotate relative to the housing, (ii) an upper extension arm, (iii) a lower extension arm provided with a pivot pin, so that the control component pivots around a pivot axis that coincides with the pivot pin, and (iv) a groove connected to one longitudinal end of the baseplates;

an intermediate junction component, wherein one end of the intermediate junction component is connected to the upper extension arm, and the other end of the intermediate junction component is connected to a pull rod;

wherein the pull rod is provided with an elongate main rod and a connection end, wherein the connection end is operatively connected to the intermediate junction component, wherein the intermediate junction component is a separate piece from the pull rod;

wherein the control component, the intermediate junction component, and the pull rod are connected in series;

wherein the intermediate junction component comprises a hooked end, a widthwise end and an intermediate junction rod, wherein the widthwise end of the intermediate junction component is operatively connected to the control component on the upper extension arm, and the hooked end of the intermediate junction component is operatively connected to the pull rod at the connection end of the pull rod;

wherein the connection end has a hole, wherein the hooked end passes through the hole to connect to the connection end; and wherein the hooked end has first and second portions, wherein the first portion is located on a first side of the connection end and the second portion is located on a second side of the connection end, wherein the first side is opposite the second side, wherein each of the first and second portions extends from the hole in a transverse direction relative to the hole beyond an edge of the hole.

2. The single-detent binder according to claim 1, wherein the widthwise end of the intermediate junction component is connected to the control component via an open trough on the upper extension arm, wherein the widthwise end passes through the open trough of the upper extension arm and connects the intermediate junction component to the handle, wherein an angle between the widthwise end and the intermediate junction rod is at a predetermined value that prevents the intermediate junction component and handle from separating from each other upon longitudinal movement of the intermediate junction component and the handle away from each other.

3. The single-detent binder according to claim 2, wherein an angle between the hooked end and the intermediate junction rod is at a sufficient value to tightly hold the hooked end to the connection end of the pull rod to prevent separation of the intermediate junction component from the pull rod during longitudinal movement of the intermediate junction component.

4. The single-detent binder according to claim 1, wherein the first portion of the hooked end is configured to engage the first side of the connection end and the second portion of the hooked end is configured to engage the second side of the connection end to hold the hooked end to the connection end of the pull rod to prevent separation of the intermediate junction component from the pull rod.

5. The single-detent binder according to claim 1, further comprising a press cap, wherein the press cap connects and fixes the control component to the housing via at least one rivet, wherein the intermediate junction rod includes an outer portion, an inner portion, and an offset portion, wherein the offset portion is positioned between the inner and outer portions, wherein the outer portion is attached to the widthwise end and the inner portion is attached to the hook end, wherein the offset portion is attached to the outer and inner portions and has a longitudinal axis that is at an angle with the inner portion, wherein the offset portion has a length, wherein the angle and the length are at predetermined values such that the outer portion and the offset portion avoid contacting the rivet during longitudinal movement of the intermediate junction component.

6. The single-detent binder according to claim 1, wherein the hooked end is u-shaped and comprises a curved bight, wherein the bight is located between the first and second portion, wherein the bight has a radius of sufficient value to tightly hold the hooked end to the connection end of the pull rod.

7. The single-detent binder according to claim 1, wherein an angle between the hooked end and the intermediate junction rod is at a sufficient value to tightly hold the hooked end to the connection end of the pull rod to prevent separation of the intermediate junction component from the pull rod during longitudinal movement of the intermediate junction component.

8. The single-detent binder according to claim 1, wherein the widthwise end of the intermediate junction component is connected to the control component via an open trough on the upper extension arm.

9. The single-detent binder according to claim 1, wherein the hooked end is u-shaped and comprises a curved bight, wherein the first portion includes a first leg, wherein the second portion includes a second leg, wherein the bight is located between the first and second leg, wherein the first leg faces a portion of the connection end adjacent the edge of the hole on the first side, wherein the second leg faces a portion of the connection end adjacent the edge of the hole on the second side.

10. The single-detent binder according to claim 1, wherein the single-detent binder also comprises at least one rotary locking piece on one of the baseplates, wherein one end of an upper surface of the rotary locking piece is rotatively connected to the one baseplate, and the other end of a lower surface of the rotary locking piece is rotatively connected to the pull rod, wherein the control component, the intermediate junction component, the pull rod and the rotary locking piece are connected in series, wherein when the control component rotates downwards, the control component pulls the intermediate junction component to move longitudinally toward the longitudinal end of the housing and triggers the pull rod to move longitudinally toward the longitudinal end of the housing, and longitudinal movement of the pull rod can trigger the rotary locking pieces to rotate toward the longitudinal end of the housing; contrarily, when the control component rotates upwards, the control component pushes the intermediate junction component to move longitudinally toward the longitudinal end of the housing and triggers the pull rod to move longitudinally toward the longitudinal end of the housing, and longitudinal movement of the pull rod can trigger the rotary locking pieces to rotate toward the longitudinal end of the housing.

11. A single-detent binder comprising:

a housing provided with a closed longitudinal end and an open longitudinal end;

at least one pair of baseplates, wherein the baseplates of the one pair of baseplates are longitudinally adjacent and parallelly arranged and connected to each other, wherein the one pair of baseplates comprises adjacent longitudinal edges and non-adjacent longitudinal edges;

one or more ring shaped components, wherein the ring shaped components each comprise two half ring shaped elements, the half ring shaped elements each are fixed on the one pair of baseplates and pass through the housing, the half ring shaped elements occlude to form a closed ring, and the half ring shaped elements disjoin to form an opened ring;

wherein the one pair of baseplates is so assembled as to pivot around the adjacent longitudinal edges in order to open or close the ring shaped components, and the non-adjacent longitudinal edges of the one pair of baseplates abut upon an inner side of the housing;

a control component comprising (i) a handle, which enables the control component to rotate relative to the housing, (ii) an upper extension arm, (iii) a lower extension arm provided with a pivot pin, so that the control component pivots around a pivot axis that coincides with the pivot pin, and (iv) a groove connected to one longitudinal end of the baseplates;

an intermediate junction component, wherein one end of the intermediate junction component is connected to the upper extension arm, and the other end of the intermediate junction component is connected to a pull rod;

wherein the pull rod is provided with an elongate main rod and a connection end, wherein the connection end is operatively connected to the intermediate junction component;

wherein the control component, the intermediate junction component, and the pull rod are connected in series;

a press cap, wherein the press cap connects and fixes the control component to the housing via at least one rivet;

wherein the intermediate junction component includes an outer portion, an inner portion, and an offset portion, wherein the offset portion is positioned between the inner and outer portions, wherein the outer portion is operatively connected to the upper extension arm and the inner portion is operatively connected to the connection end of the pull rod, wherein the offset portion is attached to the outer and inner portions and has a longitudinal axis that is at an angle with the inner portion, wherein the offset portion has a length, wherein the angle and length are at predetermined values such that the outer portion and the offset portion avoid contacting the rivet during longitudinal movement of the intermediate junction component; and at least one rotary locking piece, wherein one end of an upper surface of the rotary locking piece is rotatively connected to the one baseplate, and the other end of a lower surface of the rotary locking piece is rotatively connected to the pull rod.

12. The single-detent binder according to claim 11, wherein the intermediate junction component is integrally formed in one piece with the pull rod.

13. The single-detent binder according to claim 11, wherein the intermediate junction component is a separate piece from the pull rod.

14. The single-detent binder according to claim 11 wherein the single-detent binder also comprises at least one baffle plate on one of the baseplates.

15. The single-detent binder according to claim 11 wherein the predetermined value of the angle is forty five degrees.

16. A single-detent binder comprising:

a housing provided with a closed longitudinal end and an open longitudinal end;

at least one pair of baseplates, wherein the baseplates of the one pair of baseplates are longitudinally adjacent and parallelly arranged and connected to each other, wherein the one pair of baseplates comprises adjacent longitudinal edges and non-adjacent longitudinal edges;

one or more ring shaped components, wherein the ring shaped components each comprise two half ring shaped elements, the half ring shaped elements each are fixed on the one pair of baseplates and pass through the housing, the half ring shaped elements occlude to form a closed ring, and the half ring shaped elements disjoin to form an opened ring;

wherein the one pair of baseplates is so assembled as to pivot around the adjacent longitudinal edges in order to open or close the ring shaped components, and the non-adjacent longitudinal edges of the one pair of baseplates abut upon an inner side of the housing;

a control component comprising (i) a handle, which enables the control component to rotate relative to the housing, (ii) an upper extension arm, (iii) a lower extension arm provided with a pivot pin, so that the control component pivots around a pivot axis that coincides with the pivot pin, and (iv) a groove connected to one longitudinal end of the baseplates;

an intermediate junction component, wherein one end of the intermediate junction component is connected to the upper extension arm, and the other end of the intermediate junction component is connected to a pull rod;

wherein the pull rod is provided with an elongate main rod and a connection end, wherein the connection end is operatively connected to the intermediate junction component, wherein the intermediate junction component is a separate piece from the pull rod;

wherein the control component, the intermediate junction component, and the pull rod are connected in series;

wherein the intermediate junction component comprises a hooked end, a widthwise end and an intermediate junction rod, wherein the widthwise end of the intermediate junction component is operatively connected to the control component on the upper extension arm, and the hooked end of the intermediate junction component is operatively connected to the pull rod at the connection end of the pull rod; and wherein the predetermined value of an angle between the widthwise end and the intermediate junction component is ninety degrees, wherein the predetermined value of an angle between the hooked end and the intermediate junction rod is one hundred degrees.

17. A single-detent binder comprising:

a housing provided with a closed longitudinal end and an open longitudinal end;

at least one pair of baseplates, wherein the baseplates of the one pair of baseplates are longitudinally adjacent and parallelly arranged and connected to each other, wherein the one pair of baseplates comprises adjacent longitudinal edges and non-adjacent longitudinal edges;

one or more ring shaped components, wherein the ring shaped components each comprise two half ring shaped elements, the half ring shaped elements each are fixed on the one pair of baseplates and pass through the housing, the half ring shaped elements occlude to form a closed ring, and the half ring shaped elements disjoin to form an opened ring;

wherein the one pair of baseplates is so assembled as to pivot around the adjacent longitudinal edges in order to open or close the ring shaped components, and the non-adjacent longitudinal edges of the one pair of baseplates abut upon an inner side of the housing;

a control component comprising (i) a handle, which enables the control component to rotate relative to the housing, (ii) an upper extension arm, (iii) a lower extension arm provided with a pivot pin, so that the control component pivots around a pivot axis that coincides with the pivot pin, and (iv) a groove connected to one longitudinal end of the baseplates;

an intermediate junction component, wherein one end of the intermediate junction component is connected to the upper extension arm, and the other end of the intermediate junction component is connected to a pull rod;

wherein the pull rod is provided with an elongate main rod and a connection end, wherein the connection end is operatively connected to the intermediate junction component, wherein the intermediate junction component is a separate piece from the pull rod;

wherein the control component, the intermediate junction component, and the pull rod are connected in series;

wherein the intermediate junction component comprises a hooked end, a widthwise end and an intermediate junction rod, wherein the widthwise end of the intermediate junction component is operatively connected to the control component on the upper extension arm, and the hooked end of the intermediate junction component is operatively connected to the pull rod at the connection end of the pull rod; and at least one rotary locking piece, wherein one end of an upper surface of the rotary locking piece is rotatively connected to the one baseplate, and the other end of a lower surface of the rotary locking piece is rotatively connected to the pull rod.

18. The single-detent binder according to claim 17, wherein the single-detent binder also comprises at least one baffle plate on one of the baseplates.

19. The single-detent binder according to claim 17, wherein the control component, the intermediate junction component, the pull rod and the rotary locking piece are connected in series, wherein when the control component rotates downwards, the control component pulls the intermediate junction component to move longitudinally toward the longitudinal end of the housing and triggers the pull rod to move longitudinally toward the longitudinal end of the housing, and longitudinal movement of the pull rod can trigger the rotary locking pieces to rotate toward the longitudinal end of the housing; contrarily, when the control component rotates upwards, the control component pushes the intermediate junction component to move longitudinally toward the longitudinal end of the housing and triggers the pull rod to move longitudinally toward the longitudinal end of the housing, and longitudinal movement of the pull rod can trigger the rotary locking pieces to rotate toward the longitudinal end of the housing.

* * * * *